US005307872A

United States Patent [19]

Noyes

[11] Patent Number: 5,307,872

[45] Date of Patent: May 3, 1994

[54] AUTOMATIC CHOKE

[75] Inventor: Jonathan C. Noyes, Pleasanton, Tex.

[73] Assignee: Texaco Inc., White Plains, N.Y.

[21] Appl. No.: 43,683

[22] Filed: Apr. 8, 1993

[51] Int. Cl.[5] ..... F21B 34/00

[52] U.S. Cl. ..... 166/54; 166/320; 251/35

[58] Field of Search ..... 166/53, 54, 319, 320, 166/324; 251/25, 28, 29, 33, 35, 37, 39

[56] References Cited

U.S. PATENT DOCUMENTS 3,073,338 1/1963 Choluin et al. ..... 251/35

4,257,442 3/1981 Claycomb ..... 166/320 X 4,470,430 9/1984 Lancaster ..... 166/320 X

*Primary Examiner*—Thuy M. Bui

*Attorney, Agent, or Firm*—James L. Bailey; Kenneth R. Priem; Russell J. Egan

[57] ABSTRACT

An automatic choke has two piston-cylinder assemblies mounted within a housing having an inlet and an outlet. The piston-cylinder assemblies are connected in a closed hydraulic loop configuration. One piston-cylinder assembly is responsive to pressures at the inlet and the other piston-cylinder assembly controls valve at the outlet.

9 Claims, 1 Drawing Sheet

AUTOMATIC CHOKE

BACKGROUND OF THE INVENTION

1. Field of the Invention

The present invention concerns an automatic choke and in particular to an automatic choke which will compensate for irregular pressures developed in producing petroleum wells and to assist in their unloading and production flow.

2. The Prior Art wells producing oil and gas rely upon pressure within the well to drive the fluids to the surface. Sometimes wells have, for one reason or another, temporary or periodic irregular pressures caused by fluid loading. These variants in pressure adversely affect the production by lowering the flow rate from the well. As a well produces fluid, the pressure driving the fluid will normally drop. Production also goes down with the pressure as it is pressure dependent.

SUMMARY OF THE INVENTION

The present invention is an automatic choke unit having a pair of piston-cylinder assemblies one of which is spring loaded and the other of which controls valve means. The piston-cylinder assemblies are of different diameters and connected to form a hydraulic system which is responsive to fluid pressure in associated system thereby controlling production in that system.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
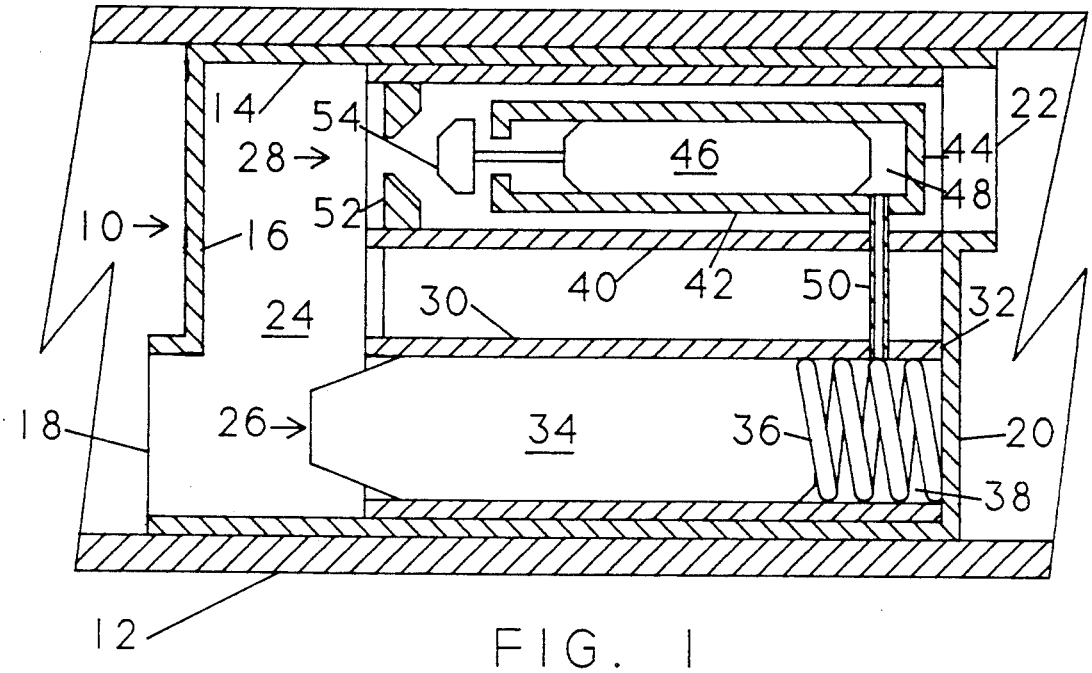
FIG. 1 is a longitudinal diagrammatic section through the automatic choke of the present invention in a first condition.
Figure 2:
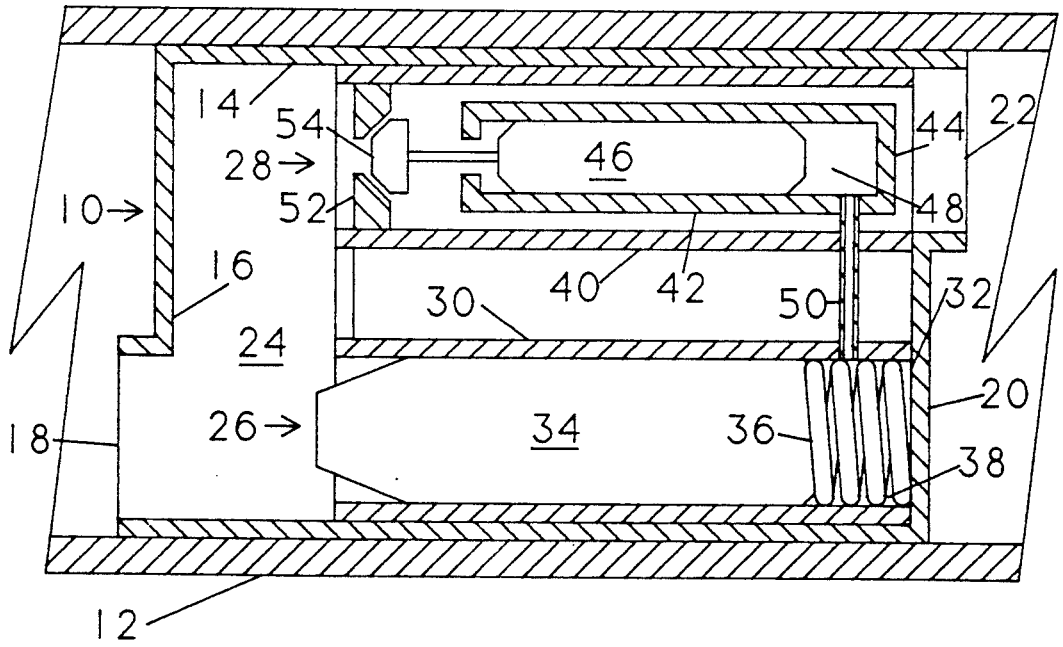
FIG. 2 is a view similar to FIG. 1 showing the subject automatic choke in a second condition.

The present invention 10 is shown in FIGS. 1 and 2 as it would be mounted in a production pipe 12. The subject automatic choke 10 has a cylindrical housing 14 having a first end plate 16 defining an inlet port 18 and a second end plate 20 defining an outlet port 22 and a central chamber 24. The inlet and outlet ports 18, 22 are oppositely axially offset. A pair of piston-cylindrical assemblies 26, 28 are mounted within chamber 24.

The first assembly 26 is generally aligned and coaxial with the inlet port 18 and the second assembly 28 is generally aligned with and coaxial with the outlet port 22. The first assembly 26 has a cylinder 30 closed at end 32 by end plate 20, a piston 34 mounted therein and biased by spring 36 mounted between the piston 34 and the end plate 20. The cylinder 30, end plate 20 and piston 34 define a variable volume chamber 38.

The second assembly 28 has an open ended outer cylinder 40 and an inner cylinder 42 coaxially mounted within the outer cylinder 40. The inner cylinder 42 is closed at one end by plate 44 and contains therein a piston 46. The cylinder 42, end plate 44 and piston 46 define a variable volume chamber 48. The chamber 48 is in fluid connection with the chamber 38 in cylinder 30 via conduit 50. A valve seat 54 is mounted in cylinder 40 directed towards the inlet end of the housing 14 and a valve member 54 is mounted on the piston 46 so as to operatively engage the valve seat 52.

The present invention will compensate for irregular pressure and flow rate of fluids in some oil and gas producing wells. As the well produces fluid, the pressure in the production pipe 12 will drop and as this happens the larger piston 34 will be pushed by spring 36 to the position shown in FIG. 1. This will reduce the fluid pressure in chambers 38 and 48 and allow the smaller piston 46 to travel away from the valve seat 52 under the pressure of the fluid flow thereby opening the valve 54 and allow flow at a faster flow rate. As the fluid is unloaded, the gas flow will return, as will the pressure, forcing the larger piston 34 to override the force of spring 36. This will cause a rise in the fluid pressure in chambers 38 and 48 causing the smaller piston 46 to begin to control the rate of gas production by closing valve member 54 towards seat 52.

This device should prove to be of particular use in inland waters and offshore areas where changing bottom-hole chokes is expensive and time consuming. The main purpose of the present invention is to control the bottom-hole pressure and blow fluid to return to the surface at a faster rate thereby keeping the well unloaded. The bottom-hole is set in the well by means of a wire line and the top section is a set of slips to hold the choke in place and bottom section consists of a seal to seal off between the tubing and choke apparatus.

While this invention has been shown and described in a downhole embodiment, it is clear that a surface automatic choke would work equally as well and would find a variety of uses in wells, pipelines etc.

The present invention may be subject to many modifications and changes without departing from the spirit or essential characteristics thereof. The present embodiment should therefore be considered is all respects as illustrative and not restrictive of the scope of the invention as defined the appending claims.

I claim:

1. An automatic choke comprising:

a housing defining a central chamber with an inlet opening on a first end and an outlet opening on an opposite second end;

a first piston cylinder assembly received in said chamber generally aligned with said inlet, the cylinder of said assembly having an open first end and a closed second end which with said piston defines a variable volume chamber, spring means in said variable volume chamber biasing said piston towards said first end;

a second piston cylinder assembly generally aligned with said outlet, the cylinder of said assembly having a closed end which with said piston defines a variable volume chamber, and a valve member carried by said piston and extending from the other end of said cylinder;

cylinder means generally aligned with said outlet and having a valve seat in the end opposite said outlet, said second piston-cylinder assembly mounted in said cylinder means so that said valve member interacts with said valve seat; and conduit means placing said variable volume chambers of said first and second piston-cylinder assemblies in fluid communication whereby movement of said first piston in response to pressure causes a counter movement of said second piston thereby controlling the positioning of said valve and flow through said choke.

2. An automatic choke according to claim 1 wherein said housing is generally cylindrical so as to be received in a production pipe.

3. An automatic choke according to claim 1 wherein said inlet opening and said outlet opening are axially oppositely offset.

4. An automatic choke according to claim 1 wherein there is a substantial difference in the area cross-section between said first and said second piston-cylinder assemblies.

5. An automatic choke comprising:

a closed housing defining a central chamber with an inlet on a first end and an outlet on a second end;

first and second piston-cylinder assemblies mounted within said chamber;

one of said piston-cylinder assemblies being responsive to pressure changes at said inlet;

valve means in said flow path having a fixed valve seat and a valve member controlled by the other of said piston-cylinder assemblies;

means connecting said piston-cylinder assemblies to form a closed hydraulic circuit whereby pressure changes at said inlet will be reflected as changes in setting of said valve thereby controlling flow through said choke.

6. The automatic choke according to claim 5 wherein said first piston-cylinder assembly comprises:

a cylinder having an open end generally directed toward said inlet opening and a closed opposite end, a piston movably mounted in said cylinder defining a variable volume chamber between it and said closed end of said cylinder, and spring means mounted in said variable volume chamber biasing said piston towards said open end.

7. The automatic choke according to claim 5 wherein said second piston-cylinder assembly comprises:

a cylinder having one closed end and a piston movably mounted within said cylinder and defining a variable volume chamber between it and said closed end of said cylinder;

said valve member carried by said piston to interact with said fixed valve seat whereby flow through said choke is controlled.

8. The automatic choke according to claim 5 wherein said valve means is generally aligned with said outlet.

9. The automatic choke according to claim 5 further comprising:

a variable volume chamber in each said piston-cylinder assembly; and said means connecting said piston-cylinder assemblies placing said variable volume chambers in fluid connection.

* * * * *